US005974685A

United States Patent [19]

Hironaka

[11] Patent Number: 5,974,685

[45] Date of Patent: Nov. 2, 1999

[54] HAND DRIER

[75] Inventor: Yasumasa Hironaka, Osaka, Japan

[73] Assignee: Funai Electric Co., Ltd, Osaka, Japan

[21] Appl. No.: 09/057,094

[22] Filed: Apr. 8, 1998

[30] Foreign Application Priority Data

Apr. 17, 1997 [JP] Japan ..... 9-100200

[51] Int. Cl.[6] ..... F26B 11/18

[52] U.S. Cl. ..... 34/202; 34/554; 62/3.4

[58] Field of Search ..... 34/524, 549, 554, 34/572, 90, 201, 202, 210, 215, 218; 62/3.3, 3.4, 93

[56] References Cited

U.S. PATENT DOCUMENTS

| | | | |
|---|---|---|---|
| 4,231,256 | 11/1980 | Chapman et al. | 73/421.5 R |
| 4,400,948 | 8/1983 | Moorehead | 62/3.3 |
| 5,280,679 | 1/1994 | Edelman | 34/66 |
| 5,507,103 | 4/1996 | Merritt | 34/97 |
| 5,724,750 | 3/1998 | Burress | 34/267 |

FOREIGN PATENT DOCUMENTS

| | | |
|---|---|---|
| 5-237045 | 2/1992 | Japan . |
| 8-117146 | 10/1994 | Japan . |

*Primary Examiner*—Henry Bennett
*Assistant Examiner*—Pamela A. Wilson
*Attorney, Agent, or Firm*—Lackenbach Siegel Marzullo Aronson & Greenspan, P.C.

[57] ABSTRACT

In a hand drier for drying the hands by blowing hot wind at the extended hands, a drying time is contracted. Unpleasant feelings are avoided by excessively increasing the hot wind temperature.

By perceiving the hands extended to the drying portion 2 with a hand sensor 9, the air is sucked by the fan 7 and the air is heated by the heater 8 to discharge the air to the drying portion 2. The Peltier effect element 6 is arranged in a ventilation passage from the air sucking opening 4 to the discharging opening 3 so that the heat sucking side A may be thermally exchanged for the air within the ventilation passage 5, so as to remove the humidity of the air.

9 Claims, 2 Drawing Sheets

HAND DRIER

BACKGROUND OF THE INVENTION

1. Field of the Invention

The present invention relates to a hand drier for blowing hot winds at extended hands to dry them.

2. Description of Related Art

This type of hand drier installed in a public toilet or the like is adapted to perceive an extended hand with a hand sensor to absorb air by a fan, and also, to heat the sucked air with a heater to blow out it from a discharging opening. This construction can allow a user to dry his hand without using towel or the like with hot winds to be blown out from the discharging opening simply by holding his wet hand to the discharging opening.

A wet hand is required to be dried as soon as possible with this type of hand drier. Japanese Patent Application Laid-Open No. 5-237045, and Japanese Patent Application Laid-Open No. 8-117146 and so on disclose improvements in a blowing out mode of hot winds from this point view. Improvements in the hot wind characteristics are considered to only increase the heating temperature of the sucked air.

But it takes more time to dry at the high humidity of the open air if even the blowing out mode of the hot winds is improved or the heating temperature of the sucked air is made higher. When the heating temperature is made high excessively, the hotter wind is felt hotter, making the user feel unpleasant.

SUMMARY OF THE INVENTION

Accordingly, an object of the present invention is to provide a hand drier which is capable of shortening the drying time without particular increase in the heating temperature of the sucking air.

The present invention relates to a hand drying comprising:

a hand sensor for perceiving a hand extended to a drying portion, a fan of sucking the air from the sucking opening to blow out the air to a drying portion from the discharging opening when the hand is perceived with the hand sensor, a heater, provided in a ventilation passage between a sucking opening and a discharging opening, for heating the air sucked by the fan, and a Peltier effect element provided in the ventilation passage so that the heat sucking side may be thermally exchanged for the air sucked by the fan.

The Peltier effect element is an element for moving the heat from one side to the other side by adding a given potential difference between two faces. A heat sucking operation is caused on one side, and a heating operation is caused on the other side. As the Peltier effect element is small in size, it can be built-in without difficulty in the ventilation passage of the hand drier. The Peltier effect element is built-in in the ventilation passage so that air sucked by the fan can be thermally exchanged for the heat sucking side of the Peltier effect element. The air is condensed in its moisture on the heat sucking side and is removed in moisture. Therefore, hot winds lower in relative humidity than those conventionally is blown out from the discharging opening, thus promoting the drying operation of the hand.

In the hand drier according to this invention, the Peltier effect element is preferable to be placed on the upstream side of a heater within the ventilation passage. When the temperature of the air is lower, the moisture amount to be contained in it is less. Air less in such moisture amount is better to remove in humidity by the Peltier effect element, thus promoting the drying operation of the hand, as compared with a case where air of higher temperature including more moisture amount is removed in humidity by the Peltier effect element. A fan is preferable to be provided on the upstream side of the heater within the ventilation passage, and the Peltier effect element is desired to be provided on the further upstream side of the fan.

The Peltier effect element is desirable to be provided to have the heating side confronted with a drying portion. The ventilation passage is preferable to be constructed so that the air thermally exchanged for the heat sucking side of the Peltier effect element may be thermally exchanged for the heating side of the Peltier effect element on the upstream side of the heater. These construction compensates the reduction of the air temperature accompanied by humidity removing on the heat sucking side, making it possible to constrain the burden increase of the heater.

EXPLANATION OF REFERENCE NUMERALS

Figure 1:
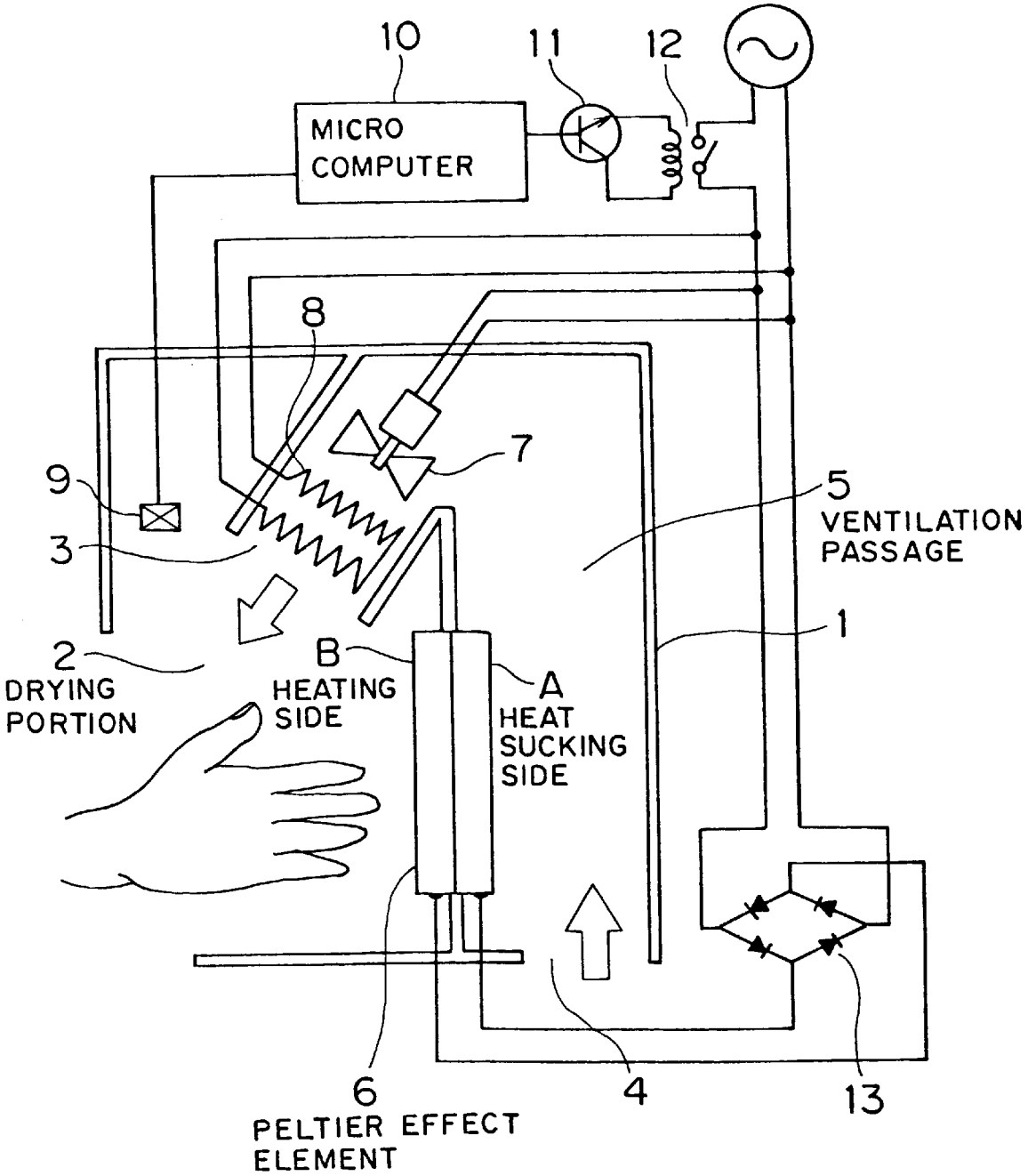
FIG. 1 is a block diagram of one embodiment of a hand drier of this invention.

1. Casing
2. Drying portion
3. Discharging opening
4. Air sucking opening
5. Ventilation passage
6. Peltier effect element
7. Fan
8. Heater
9. Hand sensor
10. Microcomputer
A Heat sucking side of the Peltier effect element 6
B Heating side of the Peltier effect element 6

DETAILED DESCRIPTION OF THE INVENTION

Now referring to the drawings, preferred embodiments of this invention are described below. FIG. 1 is a block diagram of a hand drier of one embodiment of the invention.

A hand drier according to the present embodiment is provided with a casing 1 mounted on a wall face. Although an electric circuit is shown on the outside of a casing 1 in FIG. 1, it is actually built-in in the casing 1.

In the lower portion of the casing 1 is provided a drying portion 2 opened forwards. In order to blow out the hot wind to the drying portion 2, a discharging opening 3 of the hot wind is provided upwards of it. A air sucking opening 4 is provided in the lower face of the casing 1. An ventilation passage 5 is formed in a portion from the air sucking opening 4 to the discharging opening 3 through the reverse side of the drying portion 2.

A Peltier effect element 6 is provided near the air sucking opening of the ventilation passage 5. The Peltier effect element 6 works as a partition wall for dividing the ventilation passage 5 from the drying portion 2 on its front face side. The heat sucking side A is confronted with the ventilation passage 5, and the heating side B is confronted with the drying portion 2.

On the downstream side of the Peltier effect element 6 is provided a fan 7 for sucking the air into the ventilation passage 5. On the further downstream side of the fan 7 is provided a heater 8. The air sucked by the fan 7 is heated by the heater 8 so that the hot wind is blown out to the drying portion 2 from the discharging opening 3.

Above the drying portion 2 is provided a hand sensor 9. The hand sensor 9, composed of a photoelectric element, detects hands extended into the drying portion 2 to give the detecting signal to a microcomputer 10. The microcomputer 10 receives the detection signal from the hand sensor 9 to apply a power voltage to a heater 7 and a fan 8 by the operation of a relay 12 through a driver 11. A predetermined DC voltage is applied to the Peltier effect element 6 through a rectifier 13.

Then, functions of a hand drier according to the present embodiment will be described hereinafter.

When hands are extended to the drying portion 2, the hands are perceived by a hand sensor 9 to operate the Peltier effect element 6, a fan 7 and a heater 8. The fan 7 is operated to suck the open air into the ventilation passage 5 from the air sucking opening 4.

The air sucked into the ventilation passage 5 comes into contact with the heat sucking side A of the Peltier effect element 6. The Peltier effect element 6 becomes lower in temperature on the heat sucking side A and higher on the heating side B, because the heat moves from the heat sucking side A to the heating side B by application of the predetermined potential. Thus, the air sucked into the ventilation passage 5 is cooled through the thermal exchanging for the heat sucking side A of the Peltier effect element 6 and the moisture is removed by condensation of the moisture on the heat sucking side of the Peltier effect element 6.

The humidity-removed air is heated to the predetermined temperature by the heater 8 and is blown out, in a condition where the relative humidity is reduced, from the discharging opening 3 to the drying portion 2.

In the hand drier according to the embodiment, the air sucked into the ventilation passage 5 is removed in humidity by the heat sucking side A of the Peltier effect element 6 and then, is heated by the heater 8. The hot wind of low humidity is blown out to the drying portion 2. Thus, the hands can be dried for a relatively shorter time period even in the high humidity of the open air. As the air sucked into the ventilation passage 5 is not necessary to make the temperature high excessively, the hot wind is not felt hotter.

In the hand dryer according to the embodiment, as the heating side B of the Peltier effect element 6 is confronted with the drying portion 2 to increase the atmospheric temperature of the drying portion 2, the drying operation of the hands is promoted even in terms of this point. The reduction of the air temperature accompanied by the humidity removing on the heat sucking side A is compensated, so as to reduce the burden of the heater 8.

Figure 2:
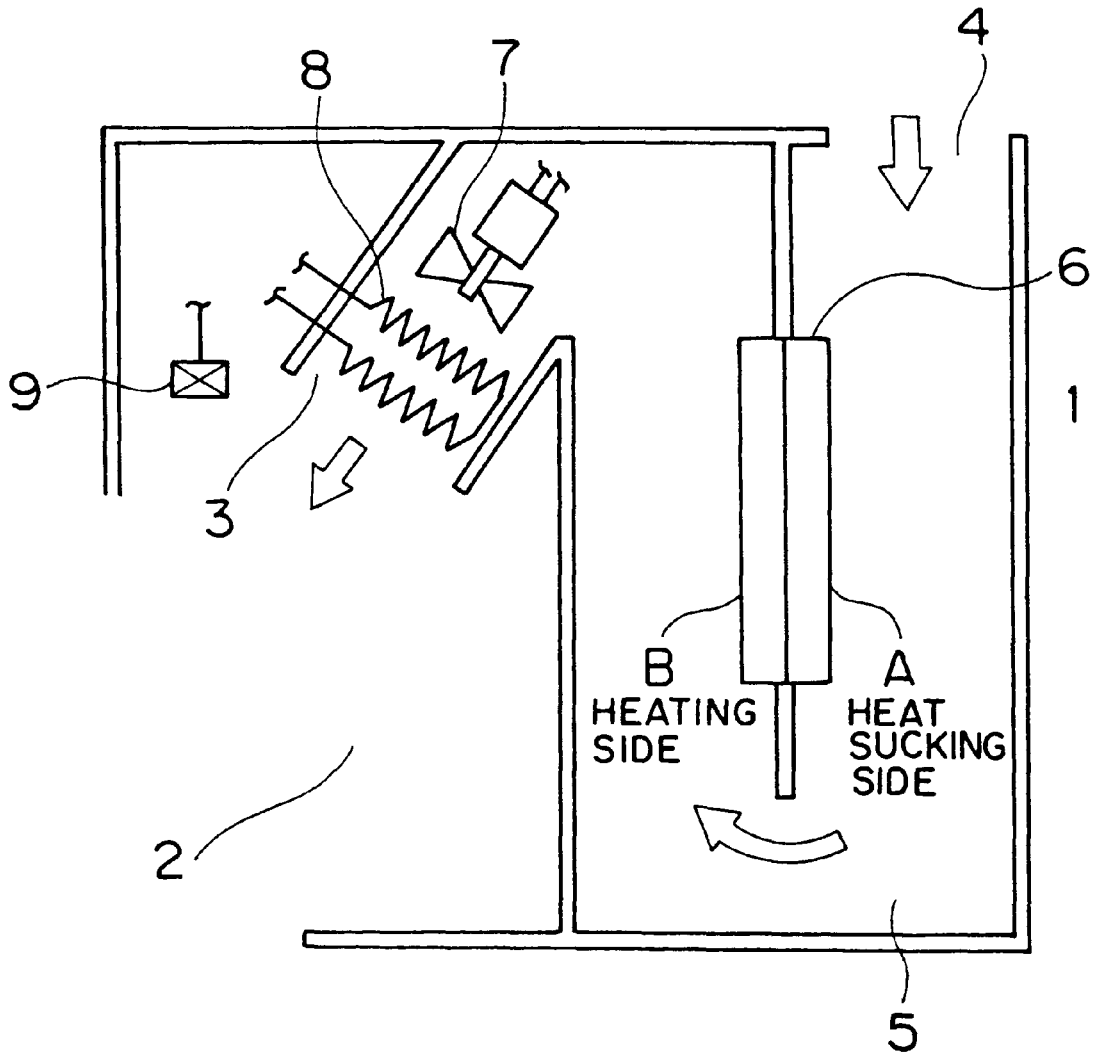
FIG. 2 is a block diagram of another embodiment of a hand drier of this invention.

FIG. 2 is a block diagram of a hand drier of another embodiment of the invention. Although the electric circuit is omitted in FIG. 2, it is the same in the circuit construction as that of FIG. 1.

In the hand drier according to the embodiment, the the air sucking opening 4 is provided on the top face of the casing 1, and an approximately U-character ventilation passage 5 is formed from the air sucking opening 4 to the discharging opening 3. The peltier effect element 6 is provided as a partition wall of the ventilation passage 5 with the heat sucking side A provided in the upstream portion and the heating side B provided in the downstream portion. Another construction is the same as that of a hand drier according to the embodiment of FIG. 1.

In the hand drier, the air sucked into the ventilation passage 5 from the air sucking opening 4 is thermally exchanged for the heat sucking side A of the Peltier effect element 6, and then, is detoured to the heating side B of the Peltier effect element 6, so as to be heated on the heating side B to be sent to the heater 8. As the air which is removed in moisture by the heat sucking side A of the Peltier effect element 6 is preheated on the heating side B of the Peltier effect element 6 and is sent to the heater 8, the reduction of the air temperature to be accompanied by the moisture removing on the heat sucking side A is offset by the preheating operation on the heating side B. Thus, the hot wind as the same in temperature as that of the conventional one is retained without raising the output of the heater 8, and the increase ratio can be constrained even when the output of the heater 8 is raised.

In the embodiments of FIG. 1 and FIG. 2, the operation of the Peltier effect element 6 is resumed from the perception of the hands. The moisture removing effect by the Peltier effect element 6 cannot be expected immediately after the perception. It takes some time to restore the moisture removing operation. Little current flows to the Peltier effect element 6 even for a period when the hands are not perceived, and it is generally effective to keep the air sucking side A low in temperature.

In order to raise the thermal exchange efficiency of the Peltier effect element 6, the Peltier effect element 6 is generally used in combination with a heat sink. It is effective to shorten a time period of restoring the moisture removing operation even in increasing of the surface, reducing the thermal capacity of the heat sink.

In the embodiments of FIG. 1 and FIG. 2, dew is attached on the heat sucking side A by humidity removing on the heat sucking side A of the Peltier effect element 6. As the Peltier effect element 6 is arranged vertically, the water drops can flow down along the surface so that the water drops can be moved outside through receiving them by a drain (not shown). The Peltier effect element 6 can be arranged obliquely. After the hands are pulled out of the drying portion 2, a current in its opposite direction can be flowed for a predetermined period of time to the Peltier effect element 6. Namely, when the current in the opposite direction is flowed into the Peltier effect element 6, the heat sucking side A is heated and the dewing is removed. At this time, the continuous operation of the fan 7 is preferable to conduct and the operation of the heater 8 can be continued together with the fan operation.

In the above described two embodiments, the drying portion 2 is formed in the lower portion of the casing 1, but the lower portion of the casing 1 can be made a drying portion 2. In this case, a discharging opening 3 can be provided in the lower face of the casing 1. It is needless to say that the fan 7 and the hand sensor 9 are not restricted to those of the embodiments. A sirocco fan is suitable as this fan 7.

As described above, in hand driers according to the claims 1, 2 and 3 of the invention, the peltier effect element may be provided in the ventilation passage within the drier so that the heat sucking side may be thermally exchanged for air sucked by a fan, so as to remove the humidity of the sucked air. The hands can be dried in a relatively shorter period of time even when the open air is high in humidity. Since the sucked air is not necessary to make the temperature high excessively, unpleasant feelings are not given to the user.

Furthermore, in the hand drier according to the inventions 4 and 5, the Peltier effect element is arranged to have the heating side confronted with the drier portion, and the ventilation passage within the drier is constructed so that the air thermally exchanged for the heat sucking side of the Peltier effect element may be thermally exchanged for the heating side of the Peltier effect element on the upstream side of the heater. Since the heating side of the Peltier effect element can be used for compensation in the reduction of the air temperature accompanied by the humidity removing on the heat sucking side, the burden increase of the heater can be constrained as soon as possible, thus resulting in superior economy.

What is claimed is:

1. A hand drier, comprising:

a hand sensor for perceiving a hand extended to a drying portion;

a fan for sucking the air from an air sucking opening to blow out the air to a drying portion from the discharging opening when the hand is perceived with a sensor;

an heater, provided in a ventilation passage between a air sucking opening and a discharging opening, for heating the air sucked by a fan; and a Peltier effect element provided in the ventilation passage so that the heat sucking side may be thermally exchanged for the sucked air.

2. The hand drier described according to claim 1, wherein a Peltier effect element is positioned on the upstream side of the heater within the ventilation passage.

3. The hand drier described according to claim 2, wherein a fan is positioned on the upstream side of a heater within the ventilation passage and the Peltier effect element is positioned on further upstream side of the fan.

4. The hand drier described according to claim 2, wherein the Peltier effect element is arranged so that the heating side is confronted with the drying portion.

5. The hand drier described according to claim 2, wherein the ventilation passage is constructed so that the air thermally exchanged for the heat sucking side of the Peltier effect element may be thermally exchanged for the heating side of the Peltier effect element on the upstream side by a heater.

6. The hand drier described according to claim 3, wherein the Peltier effect element is arranged so that the heating side is confronted with the drying portion.

7. The hand drier described according to claim 3, wherein the ventilation passage is constructed so that the air thermally exchanged for the heat sucking side of the Peltier effect element may be thermally exchanged for the heating side of the Peltier effect element on the upstream side by a heater.

8. The hand drier described according to claim 1, wherein the Peltier effect element is arranged so that the heating side is confronted with the drying portion.

9. The hand drier described according to claim 1, wherein the ventilation passage is constructed so that the air thermally exchanged for the heat sucking side of the Peltier effect element may be thermally exchanged for the heating side of the Peltier effect element on the upstream side by a heater.

* * * * *